US009437145B2

(12) United States Patent
Han et al.

(10) Patent No.: US 9,437,145 B2
(45) Date of Patent: Sep. 6, 2016

(54) GAMMA REFERENCE VOLTAGE GENERATING CIRCUIT, METHOD FOR MEASURING VOLTAGE-TRANSMISSION CURVE AND DISPLAY DEVICE

(71) Applicant: BOE TECHNOLOGY GROUP CO., LTD., Beijing (CN)

(72) Inventors: Seungwoo Han, Beijing (CN); Yuanbo Zhang, Beijing (CN); Guangliang Shang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 116 days.

(21) Appl. No.: 14/497,385

(22) Filed: Sep. 26, 2014

(65) Prior Publication Data

US 2015/0339987 A1 Nov. 26, 2015

(30) Foreign Application Priority Data

May 26, 2014 (CN) ..... 2014 1 0225985

(51) Int. Cl.
*G09G 3/36* (2006.01)

(52) U.S. Cl.
CPC ..... *G09G 3/3607* (2013.01); *G09G 3/3696* (2013.01); *G09G 2300/0408* (2013.01); *G09G 2310/027* (2013.01); *G09G 2320/0233* (2013.01); *G09G 2320/0276* (2013.01); *G09G 2320/0673* (2013.01); *G09G 2330/06* (2013.01)

(58) Field of Classification Search
CPC ..... G09G 3/3696; G09G 2320/0233; G09G 2310/027; G09G 2320/0276
See application file for complete search history.

(56) References Cited

U.S. PATENT DOCUMENTS 7,940,237 B2 * 5/2011 Hu ..... G09G 3/3225 315/169.3
2002/0145598 A1 10/2002 Shen et al.
2011/0032279 A1 2/2011 Kim et al.

FOREIGN PATENT DOCUMENTS

CN 1466122 A 1/2004
CN 101063754 A 10/2007
CN 101826307 A 9/2010
CN 102708814 A 10/2012

OTHER PUBLICATIONS

Machine translation of CN 101826307.*
(Continued)

*Primary Examiner* — Michael Pervan
(74) *Attorney, Agent, or Firm* — Harness, Dickey & Pierce, P.L.C.

(57) ABSTRACT

The present disclosure provides a gamma reference voltage generating circuit including a center voltage generation unit, a gamma reference voltage generation unit configured to generate positive and negative gamma reference voltages and control the positive gamma reference voltage and the negative gamma reference voltage to be symmetrical with respect to the center voltage; a first voltage divider unit including a first terminal for receiving the positive gamma reference voltage and a second terminal for receiving the center voltage; and a second voltage divider unit including a first terminal coupled with the second terminal of the first voltage divider unit and a second terminal for receiving the negative gamma reference voltage.

14 Claims, 5 Drawing Sheets

(56) References Cited

OTHER PUBLICATIONS

Machine translattion of CN 102708814.*

First Office Action regarding Chinese application No. 201410225985.8, dated Nov. 4, 2015. Translation provided by Dragon Intellectual Property Law Firm.

* cited by examiner

GAMMA REFERENCE VOLTAGE GENERATING CIRCUIT, METHOD FOR MEASURING VOLTAGE-TRANSMISSION CURVE AND DISPLAY DEVICE

CROSS-REFERENCE TO RELATED APPLICATION

This application claims priority to Chinese Patent Application No. 201410225985.8 filed on May 26, 2014, the disclosures of which are incorporated in their entirety by reference herein.

TECHNICAL FIELD

The present disclosure relates to the field of display technology, and more particularly to a gamma reference voltage generating circuit, a method for measuring a voltage-transmission (V-T) curve and a display device.

BACKGROUND

In a circuit board of a liquid crystal display panel, a gamma reference voltage is used to obtain a gray-scale voltage through an internal divider resistor network of a source driver. Voltages applied to liquid crystal molecules are actually differences of different gray-scale voltages and a common electrode voltage (VCOM). In order to prevent aging of liquid crystal material, the voltages applied to two ends of the liquid crystal molecules are not allowed to have a direct current component. When entering a next frame after completion of scanning of a previous frame, it is needed to change polarities of the voltages applied to the liquid crystal molecules, thus, under ideal conditions, for a certain gray-scale image, there are two voltages including a positive voltage and a negative voltage relative to VCOM, the two voltages have same charge and opposite polarities.

However, in practical work, when a voltage of a gate line is changed, correctness of voltages of pixel electrodes may be affected through a parasitic capacitance between the gate line and the pixel electrodes, resulting in that positive and negative display areas are asymmetrical with respective to VCOM, thereby applying a direct-current component $\Delta Vp$ on the pixel electrodes.

A current liquid crystal panel is designed to compensate the asymmetry of the positive and negative display areas caused by the direct-current component $\Delta Vp$ by adjusting VCOM. However, such an adjustment is usually performed only one time. When the liquid crystal panel is used in a client terminal, $\Delta Vp$ in the liquid crystal panel may be changed due to displaying a fixed screen for a long time, in a hot and humid environment and leakage current of a thin film transistor (TFT). Thus, there is a deviation between an actually adjusted VCOM and an ideal VCOM of the panel. Even under conditions of constant gray-scale voltages, the positive and negative display areas are asymmetrical with respective to VCOM. There is also a deviation in data of the positive and negative areas, and this deviation is a direct-current component; when this direct-current component is applied to the liquid crystal display panel for a long time, a residual image may appear due to characteristics of the liquid crystal molecules.

SUMMARY

A main object of the present disclosure is to provide a gamma reference voltage generating circuit, a method for measuring a voltage-transmission curve and a display device, which can eliminate the problem of the presence of a residual image on the display panel which is caused when direct current voltage drop changes of voltages of a common electrode caused by leakage current causes the positive gamma reference voltage and the negative gamma reference voltage to not be able to be symmetrical with respect to the center voltage.

In order to achieve the above object, one embodiment of the present disclosure provides a gamma reference voltage generating circuit used to provide a gamma reference voltage for a source driver when measuring a V-T curve of a display panel; the gamma reference voltage including a positive gamma reference voltage and a negative gamma reference voltage. The gamma reference voltage generating circuit includes a center voltage generation unit configured to generate a center voltage; a gamma reference voltage generation unit configured to generate the positive gamma reference voltage and the negative gamma reference voltage, and control the positive gamma reference voltage and the negative gamma reference voltage to be symmetrical with respect to the center voltage; a first voltage divider unit including a first terminal for receiving the positive gamma reference voltage and a second terminal for receiving the center voltage; the first voltage divider unit being configured to divide a voltage between the positive gamma reference voltage and the center voltage; and a second voltage divider unit including a first terminal for receiving the center voltage, and a second terminal for receiving the negative gamma reference voltage; the second voltage divider unit being configured to divide a voltage between the center voltage and the negative gamma reference voltage.

Further, each of the first voltage divider unit and the second voltage divider unit includes only one divider resistor; and the only one divider resistor of the first voltage divider unit and the only one divider resistor of the second voltage divider unit have a same resistance value.

Further, the first voltage divider unit includes a plurality of divider resistors connected in series; and the second voltage divider unit includes a plurality of divider resistors connected in series.

Further, the gamma reference voltage generating circuit of one embodiment of the present disclosure further includes: a third voltage divider unit including a first terminal for receiving the positive gamma reference voltage, and a second terminal for receiving a first driving voltage; the third voltage divider unit being configured to divide a voltage between the positive gamma reference voltage and the first driving voltage; and a fourth voltage divider unit including a first terminal for receiving the negative gamma reference voltage, and a second terminal for receiving a second driving voltage; the fourth voltage divider unit being configured to divide a voltage between the negative gamma reference voltage and the second driving voltage.

Further, each of the third voltage divider unit and the fourth voltage divider unit includes only one divider resistor; and the only one divider resistor of the divider unit and the only one divider resistor of the fourth voltage divider unit have a same resistance value.

Further, the third voltage divider unit includes a plurality of divider resistors connected in series; and the fourth voltage divider unit includes a plurality of divider resistors connected in series.

Further, the gamma reference voltage generation unit includes a first voltage follower including an input terminal for receiving a test voltage, and an output terminal coupled with the first terminal of the first voltage divider unit; a first negative feedback operational amplifier including a positive input terminal for receiving the center voltage, an inverting input terminal for receiving the test voltage through an input resistor, an output terminal coupled with the inverting input terminal of the first negative feedback operational amplifier through a feedback resistor; the output terminal of the first negative feedback operational amplifier coupled with the second terminal of the second voltage divider unit; wherein the positive gamma reference voltage and the negative gamma reference voltage are controlled to be symmetrical with respect to the center voltage by adjusting resistance values of the input resistor and the feedback resistor.

Further, the resistance value of the feedback resistor is equal to the resistance value of the input resistor.

Further, the center voltage is equal to a common electrode voltage minus a direct current voltage drop ΔVp;

$$\Delta Vp = Cgd/(Clc+Cst+Cgd)\times(Vgh-Vgl);$$

where, Cgd is a gate-drain capacitance; Clc is a liquid crystal capacitance, Cst is a storage capacitance, Vgh is a positive gate line threshold voltage, Vgh is a negative gate line cut-off voltage.

Further, the center voltage generation unit includes: a first voltage divider module including a first terminal for receiving the first driving voltage; a second voltage divider module including a first terminal coupled with a second terminal of the first voltage divider module, and a second terminal for receiving the second driving voltage; and a second voltage follower including an input terminal coupled with a second terminal of the first voltage divider module, and an output terminal for outputting the center voltage.

Further, the second voltage follower includes a second negative feedback operational amplifier; the second negative feedback operational amplifier includes a positive input terminal, an inverting input terminal and an output terminal; wherein the positive input terminal of the second negative feedback operational amplifier is the input terminal of the second voltage follower; the inverting input terminal of the second negative feedback operational amplifier is coupled with the output terminal of the second negative feedback operational amplifier; the output terminal of the second negative feedback operational amplifier is the output terminal of the second voltage follower.

Further, the first voltage divider module includes at least one resistor; the second voltage divider module includes at least one resistor.

One embodiment of the present disclosure provides a method for measuring a voltage-transmission curve which adopts the above gamma reference voltage generating circuit to measure the voltage-transmission curve of a display panel; the method includes: generating a plurality of gamma reference voltages by the gamma reference voltage generating circuit; sequentially inputting by the gamma reference voltage generating circuit, the gamma reference voltages into a source driver, and detecting brightness of a gray-scale image of the display panel corresponding to each of the gamma reference voltages; obtaining the voltage-transmission curve according to each of the gamma reference voltages and brightness corresponding to each of the gamma reference voltages.

Further, among the plurality of gamma reference voltages, differences between every two gamma reference voltages whose values are most closed to each other are equal.

One embodiment of the present disclosure provides a display device including a source driver and the above gamma reference voltage generating circuit. The gamma reference voltage generating circuit provides a positive gamma reference voltage and a negative gamma reference voltage for the source driver.

In the gamma reference voltage generating circuit, the method for measuring a V-T curve and the display device, the gamma reference voltage generation unit is adopted to control the positive gamma reference voltage and the negative gamma reference voltage which are input to the source driver to be symmetrical with respect to the center voltage, so as to eliminate the problem of the presence of a residual image on the display panel which is caused when direct current voltage drop changes of voltages of a common electrode caused by leakage current causes the positive gamma reference voltage and the negative gamma reference voltage to not be able to be symmetrical with respect to the center voltage.

DETAILED DESCRIPTION

Figure 1:
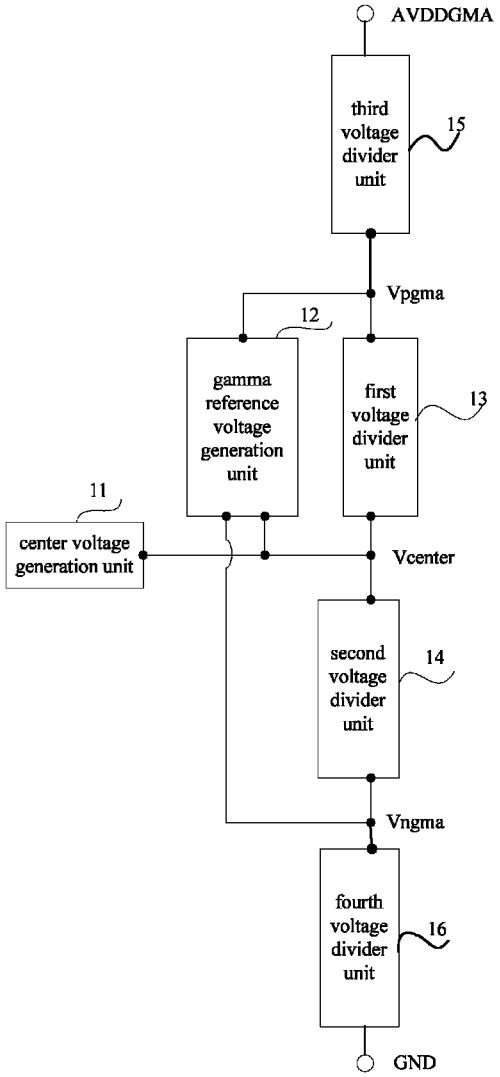
FIG. 1 is a schematic diagram showing a structure of a gamma reference voltage generating circuit according to one embodiment of the present disclosure.

FIG. 1 is a schematic diagram showing a structure of a gamma reference voltage generating circuit according to one embodiment of the present disclosure. As shown in FIG. 1, the gamma reference voltage generating circuit is used to provide a gamma reference voltage for a source driver when measuring a voltage-transmission (V-T) curve of a display panel. The gamma reference voltage includes a positive gamma reference voltage Vpgma and a negative gamma reference voltage Vngma. The gamma reference voltage generating circuit includes:

a center voltage generation unit 11 configured to generate a center voltage Vcenter;

a gamma reference voltage generation unit 12 configured to generate the positive gamma reference voltage Vpgma and the negative gamma reference voltage Vngma, and control the positive gamma reference voltage Vpgma and the negative gamma reference voltage Vngma to be symmetrical with respect to the center voltage Vcenter;

a first voltage divider unit 13 including a first terminal for receiving the positive gamma reference voltage Vpgma and a second terminal for receiving the center voltage Vcenter; the first voltage divider unit 13 being configured to divide a voltage between the positive gamma reference voltage Vpgma and the center voltage Vcenter; and a second voltage divider unit 14 including a first terminal coupled with the second terminal of the first voltage divider unit 13, and a second terminal for receiving the negative gamma reference voltage Vngma; the second voltage divider unit 14 being configured to divide a voltage between the center voltage Vcenter and the negative gamma reference voltage Vngma.

In the gamma reference voltage generating circuit used for measuring the V-T curve, the gamma reference voltage generation unit 12 is adopted to control the positive gamma reference voltage Vpgma and the negative gamma reference voltage Vngma which are input to the source driver to be symmetrical with respect to the center voltage Vcenter, so as to eliminate the problem of the presence of a residual image on the display panel which is caused when direct current voltage drop changes of voltages of a common electrode caused by leakage current causes the positive gamma reference voltage and the negative gamma reference voltage to not be able to be symmetrical with respect to the center voltage.

In actual operation, when the gamma reference voltage generating circuit of one embodiment of the present disclosure is used to measure the V-T curve, the first voltage divider unit 13 and the second voltage divider unit 14 each may include only one divider resistor of a same resistance value, respectively, and the V-T curve may be measured only through changing a voltage value of the positive gamma reference voltage Vpgma and a voltage value of the negative gamma reference voltage Vngma. When the gamma reference voltage generating circuit of one embodiment of the present disclosure is used to provide gamma voltages for a display panel, the first voltage divider unit 13 including a plurality of divider resistors connected in series and the second voltage divider unit 14 including a plurality of divider resistors connected in series are required to divide a voltage between the positive gamma reference voltage Vpgma and the center voltage Vcenter, and a voltage between the center voltage Vcenter and the negative gamma reference voltage Vngma, respectively, so as to generate a plurality of positive gamma voltages and a plurality of negative gamma voltages.

In actual operation, as shown in FIG. 1, the gamma reference voltage generating circuit of one embodiment of the present disclosure further includes:

a third voltage divider unit 15 including a first terminal for receiving the positive gamma reference voltage Vpgma, and a second terminal for receiving a first driving voltage AVDDGMA; the third voltage divider unit 15 being configured to divide a voltage between the positive gamma reference voltage Vpgma and the first driving voltage AVDDGMA, so as to generate a plurality of positive gamma voltages between the positive gamma reference voltage and the first driving voltage; and a fourth voltage divider unit 16 including a first terminal for receiving the negative gamma reference voltage Vngma, and a second terminal for receiving a second driving voltage; the fourth voltage divider unit 16 being configured to divide a voltage between the negative gamma reference voltage Vngma and the second driving voltage, so as to generate a plurality of negative gamma voltages between the negative gamma reference voltage and the second driving voltage.

According to different sizes of display panels, a value of the first driving voltage AVDDGMA may be 15V, 12V, 8V, or other suitable voltages.

In the embodiment shown in FIG. 1, the second driving voltage is 0V, the second terminal of the fourth voltage divider unit 16 is connected to a ground terminal (GND).

In actual operation, when the gamma reference voltage generating circuit of one embodiment of the present disclosure is used to measure the V-T curve, the third voltage divider unit 15 and the fourth voltage divider unit 16 each may include only one divider resistor of a same resistance value, respectively. When the gamma reference voltage generating circuit of one embodiment of the present disclosure is used to provide gamma voltages for a display panel, the third voltage divider unit 15 including a plurality of divider resistors connected in series and the fourth voltage divider unit 16 including a plurality of divider resistors connected in series are required to divide a voltage between the positive gamma reference voltage Vpgma and the first driving voltage AVDDGMA, and a voltage between the negative gamma reference voltage Vngma and the second driving voltage, respectively, so as to generate a plurality of positive gamma voltages and a plurality of negative gamma voltages.

Figure 2:
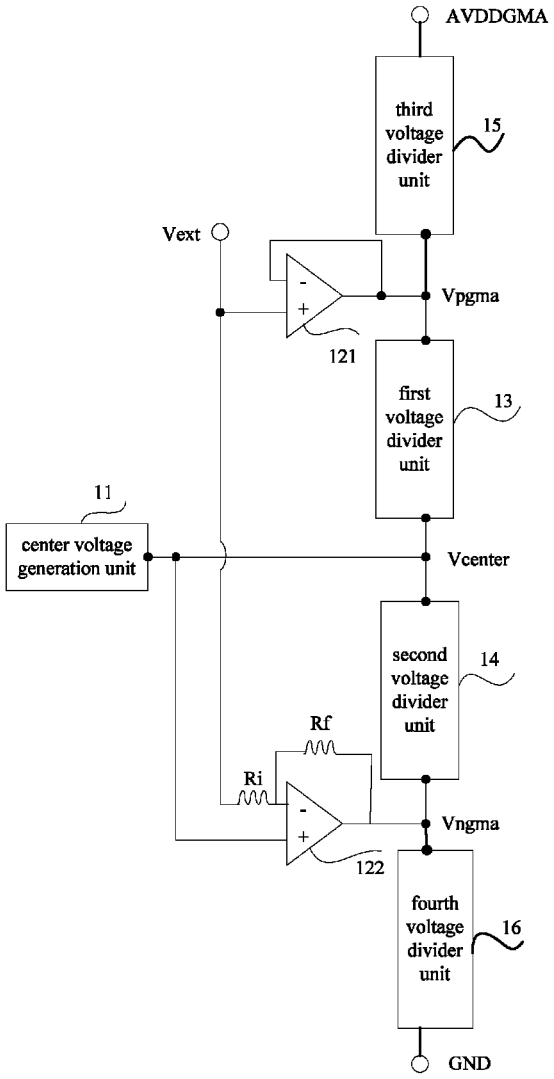
FIG. 2 is a schematic diagram showing a structure of a gamma reference voltage generating circuit according to another embodiment of the present disclosure.

Specifically, in one embodiment, as shown in FIG. 2, the gamma reference voltage generation unit 12 includes:

a first voltage follower 121 including an input terminal for receiving a test voltage Vext, and an output terminal coupled with the first terminal of the first voltage divider unit 13;

a first negative feedback operational amplifier 122 including a positive input terminal for receiving the center voltage Vcenter, an inverting input terminal for receiving the test voltage Vext through an input resistor Ri, an output terminal coupled with the inverting input terminal of the first negative feedback operational amplifier 122 through a feedback resistor Rf; the output terminal of the first negative feedback operational amplifier 122 further being coupled with the second terminal of the second voltage divider unit 14.

By adjusting resistance values of the input resistor Ri and the feedback resistor Rf, the positive gamma reference voltage Vpgma and the negative gamma reference voltage Vngma are controlled to be symmetrical with respect to the center voltage Vcenter.

In the embodiment shown in FIG. 2, an output voltage of the first voltage follower 121 is approximate to an input voltage; the first voltage follower 121 presents a high impedance state to a front-end circuit, and presents a low impedance state to a back-end circuit, thus plays a role of isolation for the front-end circuit and the back-end circuit.

For the first negative feedback operational amplifier 122, Vngma=Vcenter−Rf(Vext−Vcenter)/Ri, the value of Vngma may be adjusted by adjusting Rf/Ri, so that Vngma and Vpgma are symmetrical with respect to the center voltage Vcenter.

Optionally, when Rf=Ri, Vext−Vcenter=Vcenter−Vngma, Vext=Vpgma, then Vpgma−Vcenter=Vcenter−Vngma, that is, Vngma and Vpgma are symmetrical with respect to the center voltage Vcenter.

In actual implementation, the center voltage Vcenter is equal to the common electrode voltage minus a direct current voltage drop ΔVp;

$$\Delta Vp = Cgd/(Clc+Cst+Cgd)\times(Vgh-Vgl)$$

where, Cgd is a gate-drain capacitance; Clc is a liquid crystal capacitance, Cst is a storage capacitance, Vgh is a positive gate line threshold voltage, Vgh is a negative gate line cut-off voltage;

ΔVp is a coupling drop caused by the gate-drain capacitance when a gate line pulse signal is changed.

Figure 3:
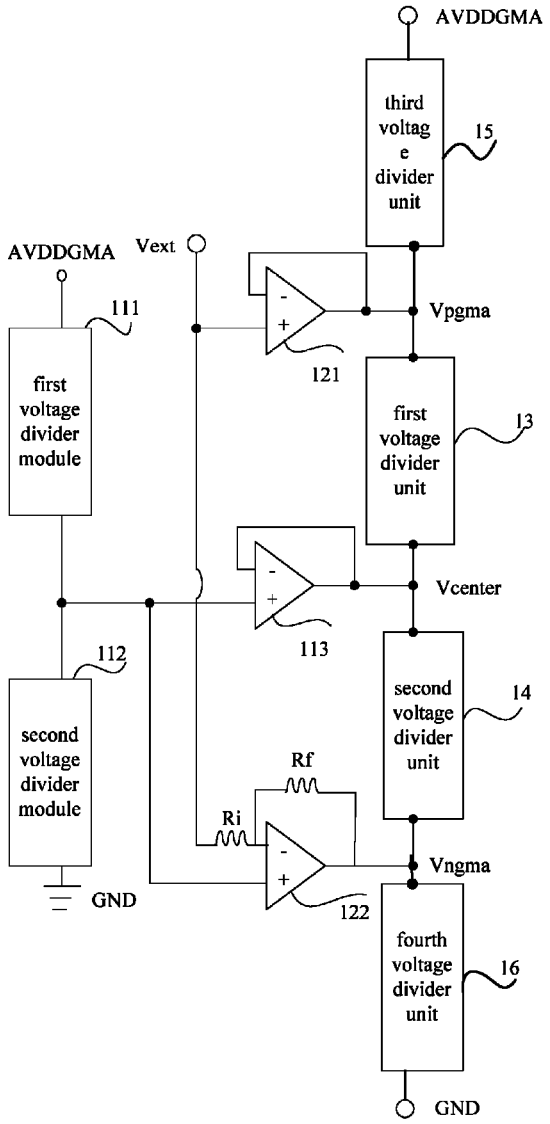
FIG. 3 is a schematic diagram showing a structure of a gamma reference voltage generating circuit according to yet another embodiment of the present disclosure.

Specifically, in one embodiment, as shown in FIG. 3, the center voltage generation unit 11 includes:

a first voltage divider module 111 including a first terminal for receiving the first driving voltage AVDDGMA;

a second voltage divider module 112 including a first terminal coupled with a second terminal of the first voltage divider module 111, and a second terminal for receiving the second driving voltage; and a second voltage follower 113 including an input terminal coupled with a second terminal of the first voltage divider module 111, and an output terminal for outputting the center voltage Vcenter.

According to different sizes of display panels, a value of the first driving voltage AVDDGMA may be 15V, 12V, 8V, or other suitable voltages.

In the embodiment shown in FIG. 3, the second driving voltage is 0V, the second terminal of the second voltage divider module 112 is connected to a ground terminal (GND).

In one embodiment, as shown in FIG. 3, the second voltage follower 113 includes a second negative feedback operational amplifier. A positive input terminal of the second negative feedback operational amplifier is the input terminal of the second voltage follower 113. An inverting input terminal of the second negative feedback operational amplifier is coupled with an output terminal of the second negative feedback operational amplifier. An output terminal of the second negative feedback operational amplifier is the output terminal of the second voltage follower 113.

Figure 4:
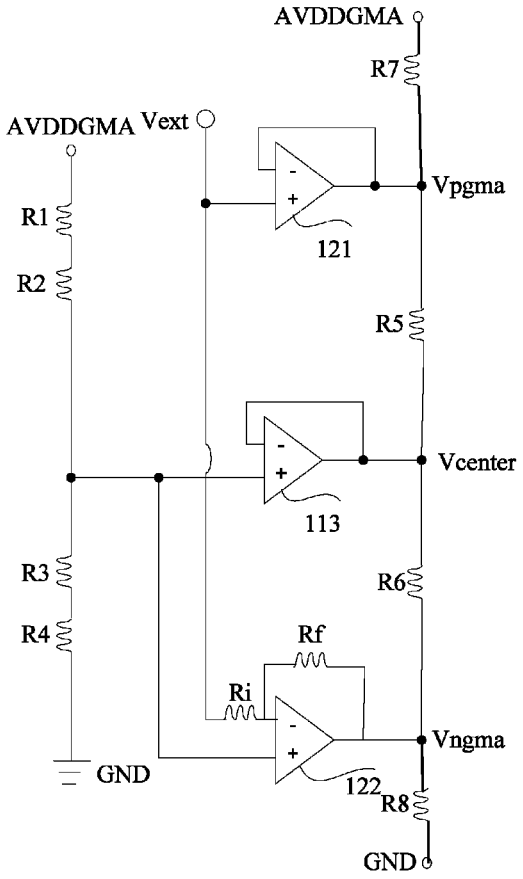
FIG. 4 is a schematic diagram showing a structure of a gamma reference voltage generating circuit according to still another embodiment of the present disclosure.

Specifically, in one embodiment, as shown in FIG. 4, the first voltage divider module 111 includes a first resistor R1 and a second resistor R2 connected in series; the second voltage divider module 112 includes a third resistor R3 and a fourth resistor R4 connected in series; the first voltage divider unit 13 includes a fifth resistor R5; the second voltage divider unit 14 includes a sixth resistor R6, the third voltage divider unit 15 includes a seventh resistor R7, and the fourth voltage divider unit 16 includes an eighth resistor R8.

In actual operation, the number of resistors included in the first voltage divider module 111 or the second voltage divider module 112 is not limited to two, and may be one, three, and may be set according to actual requirements.

Similarly, each of the first voltage divider unit 13, the second voltage divider unit 14, the third voltage divider unit 15 and the fourth voltage divider unit 16 is not limited to include only one resistor, and may include a plurality of resistor connected in series, and the number of resistors thereof may be set according to actual requirements.

In actual operation, when the gamma reference voltage generating circuit of one embodiment of the present disclosure is used to measure the V-T curve, the first voltage divider unit 13, the second voltage divider unit 14, the third voltage divider unit 15 and the fourth voltage divider unit 16 each may include only one divider resistor of a same resistance value, respectively, and the V-T curve may be measured only through changing a voltage value of the positive gamma reference voltage and a voltage value of the negative gamma reference voltage. When the gamma reference voltage generating circuit of one embodiment of the present disclosure is used to provide gamma voltages for a display panel, the first voltage divider unit 13 including a plurality of divider resistors connected in series and the second voltage divider unit 14 including a plurality of divider resistors connected in series are required to divide a voltage between the positive gamma reference voltage Vpgma and the center voltage Vcenter, and a voltage between the center voltage Vcenter and the negative gamma reference voltage Vngma, respectively, so as to generate a plurality of positive gamma voltages and a plurality of negative gamma voltages; the third voltage divider unit 15 including a plurality of divider resistors connected in series and the fourth voltage divider unit 16 including a plurality of divider resistors connected in series are required to divide a voltage between the positive gamma reference voltage Vpgma and the first driving voltage AVDDGMA, and a voltage between the negative gamma reference voltage Vngma and the second driving voltage, respectively, so as to generate a plurality of positive gamma voltages and a plurality of negative gamma voltages.

Figure 5:
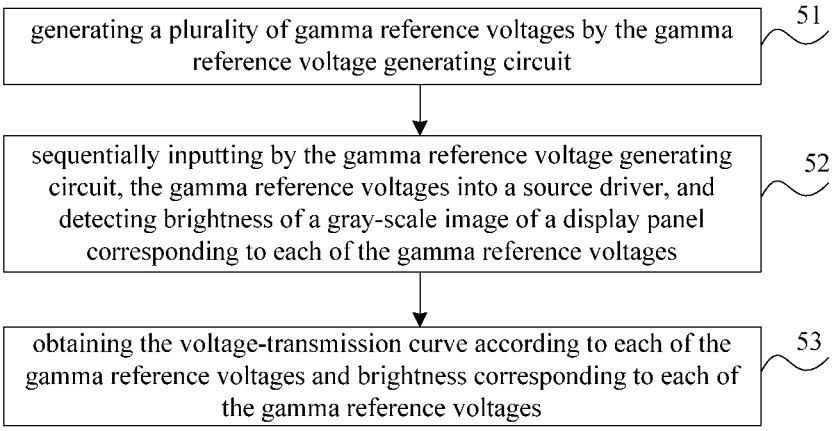
FIG. 5 is a flow chart of a method for measuring a voltage-transmission (V-T) curve according to one embodiment of the present disclosure.

As shown in FIG. 5, one embodiment of the present disclosure further provides a method for measuring a V-T curve, which adopts the above gamma reference voltage generating circuit to measure a voltage-transmission curve of a display panel. The method includes:

Step 51: generating a plurality of gamma reference voltages by the gamma reference voltage generating circuit;

Step 52: sequentially inputting by the gamma reference voltage generating circuit, the gamma reference voltages into a source driver, and detecting brightness of a gray-scale image of a display panel corresponding to each of the gamma reference voltages;

Step 53: obtaining the voltage-transmission curve according to each of the gamma reference voltages and brightness corresponding to each of the gamma reference voltages.

In the method for measuring a V-T curve of one embodiment of the present disclosure, the gamma reference voltage generating circuit of one embodiment of the present disclosure is adopted to generate the positive gamma reference voltage and the negative gamma reference voltage which are symmetrical with respect to the center voltage, and thus, an accurate V-T curve may be obtained.

Optionally, in the method for measuring a V-T curve of one embodiment of the present disclosure, among the plurality of gamma reference voltages, differences between every two gamma reference voltages whose values are most closed to each other are equal, so that sampling points of pixel voltages and brightness obtained by sampling are uniform, thereby obtaining a more accurate V-T curve.

Specifically, when the gamma reference voltage generating circuit shown in FIGS. 1-4 is used to measure the V-T curve of a display panel, controlling the positive gamma reference voltage Vpgma and the negative gamma reference voltage Vngma to be symmetrical with respect to the center voltage Vcenter, selecting a plurality of groups of gamma reference voltages (which include a positive gamma reference voltage and a negative gamma reference voltage) in order from small to large absolute values of differences between the gamma reference voltages and the center voltage, inputting the plurality of groups of gamma reference voltages into the source driver, detecting brightness of a gray-scale image of a display panel corresponding to each of the groups of gamma reference voltages, and obtaining the voltage-transmission curve according to each of the groups of gamma reference voltages and brightness corresponding to each of groups of gamma reference voltages.

Specifically, when the gamma reference voltage generating circuit shown in FIGS. 1-4 is used to measure the V-T curve of a display panel, a plurality of gamma reference voltages may be generated by adjusting the test voltage Vext. A value of the Vext may range from 0V to AVDDGMA. Each adjustment takes 0.1V as a test unit.

One embodiment of the present disclosure further provides a display device, which includes a source driver and the above gamma reference voltage generating circuit. The gamma reference voltage generating circuit provides a positive gamma reference voltage and a negative gamma reference voltage for the source driver.

The foregoing are merely exemplary embodiments of the present disclosure. It should be appreciated that, a person skilled in the art may make further modifications and improvements without departing from the scope of the present disclosure, and these modifications and improvements should also be considered as within the scope of the present disclosure.

What is claimed is:

1. A gamma reference voltage generating circuit used to provide a gamma reference voltage for a source driver; the gamma reference voltage comprising a positive gamma reference voltage and a negative gamma reference voltage; the gamma reference voltage generating circuit comprising:

a center voltage generation unit configured to generate a center voltage;

a gamma reference voltage generation unit configured to generate the positive gamma reference voltage and the negative gamma reference voltage, and control the positive gamma reference voltage and the negative gamma reference voltage to be symmetrical with respect to the center voltage;

a first voltage divider unit comprising a first terminal for receiving the positive gamma reference voltage and a second terminal for receiving the center voltage; the first voltage divider unit being configured to divide a voltage between the positive gamma reference voltage and the center voltage; and a second voltage divider unit comprising a first terminal for receiving the center voltage, and a second terminal for receiving the negative gamma reference voltage; the second voltage divider unit being configured to divide a voltage between the center voltage and the negative gamma reference voltage, wherein the gamma reference voltage generation unit comprises: a first voltage follower comprising an input terminal for receiving a test voltage, and an output terminal coupled with the first terminal of the first voltage divider unit;

a first negative feedback operational amplifier comprising a positive input terminal for receiving the center voltage, an inverting input terminal for receiving the test voltage through an input resistor, an output terminal coupled with the inverting input terminal of the first negative feedback operational amplifier through a feedback resistor; the output terminal of the first negative feedback operational amplifier coupled with the second terminal of the second voltage divider unit;

wherein the positive gamma reference voltage and the negative gamma reference voltage are controlled to be symmetrical with respect to the center voltage by adjusting resistance values of the input resistor and the feedback resistor.

2. The gamma reference voltage generating circuit according to claim 1, wherein each of the first voltage divider unit and the second voltage divider unit comprises only one divider resistor; and the only one divider resistor of the first voltage divider unit and the only one divider resistor of the second voltage divider unit have a same resistance value.

3. The gamma reference voltage generating circuit according to claim 1, wherein the first voltage divider unit comprises a plurality of divider resistors connected in series; and the second voltage divider unit comprises a plurality of divider resistors connected in series.

4. The gamma reference voltage generating circuit according to claim 1, further comprising:

a third voltage divider unit comprising a first terminal for receiving the positive gamma reference voltage, and a second terminal for receiving a first driving voltage; the third voltage divider unit being configured to divide a voltage between the positive gamma reference voltage and the first driving voltage; and a fourth voltage divider unit comprising a first terminal for receiving the negative gamma reference voltage, and a second terminal for receiving a second driving voltage; the fourth voltage divider unit being configured to divide a voltage between the negative gamma reference voltage and the second driving voltage.

5. The gamma reference voltage generating circuit according to claim 4, wherein each of the third voltage divider unit and the fourth voltage divider unit comprises only one divider resistor; and the only one divider resistor of the third voltage divider unit and the only one divider resistor of the fourth voltage divider unit have a same resistance value.

6. The gamma reference voltage generating circuit according to claim 4, wherein the third voltage divider unit comprises a plurality of divider resistors connected in series; and the fourth voltage divider unit comprises a plurality of divider resistors connected in series.

7. The gamma reference voltage generating circuit according to claim 1, wherein the resistance value of the feedback resistor is equal to the resistance value of the input resistor.

8. A method for measuring a voltage-transmission curve which adopts a gamma reference voltage generating circuit according to claim 1 to measure the voltage-transmission curve of a display panel; the method comprising:

generating a plurality of gamma reference voltages by the gamma reference voltage generating circuit;

sequentially inputting, by the gamma reference voltage generating circuit, the gamma reference voltages into a source driver, and detecting brightness of a gray-scale image of the display panel corresponding to each of the gamma reference voltages;

obtaining the voltage-transmission curve according to each of the gamma reference voltages and brightness corresponding to each of the gamma reference voltages.

9. The method according to claim 8, wherein among the plurality of gamma reference voltages, differences between every two gamma reference voltages whose values are most closed to each other are equal.

10. A display device comprising a source driver and a gamma reference voltage generating circuit according to claim 1; wherein the gamma reference voltage generating circuit provides a positive gamma reference voltage and a negative gamma reference voltage for the source driver.

11. A gamma reference voltage generating circuit used to provide a gamma reference voltage for a source driver; the gamma reference voltage comprising a positive gamma reference voltage and a negative gamma reference voltage; the gamma reference voltage generating circuit comprising:

a center voltage generation unit configured to generate a center voltage;

a gamma reference voltage generation unit configured to generate the positive gamma reference voltage and the negative gamma reference voltage, and control the positive gamma reference voltage and the negative gamma reference voltage to be symmetrical with respect to the center voltage;

a first voltage divider unit comprising a first terminal for receiving the positive gamma reference voltage and a second terminal for receiving the center voltage; the first voltage divider unit being configured to divide a voltage between the positive gamma reference voltage and the center voltage; and a second voltage divider unit comprising a first terminal for receiving the center voltage, and a second terminal for receiving the negative gamma reference voltage; the second voltage divider unit being configured to divide a voltage between the center voltage and the negative gamma reference voltage, wherein the center voltage is equal to a common electrode voltage minus a direct current voltage drop ΔVp;

$$\Delta Vp = Cgd/(Clc+Cst+Cgd)\times(Vgh-Vgl);$$

where, Cgd is a gate-drain capacitance; Clc is a liquid crystal capacitance, Cst is a storage capacitance, Vgh is a positive gate line threshold voltage, Vgl is a negative gate line cut-off voltage.

12. The gamma reference voltage generating circuit according to claim 11, wherein the center voltage generation unit comprises:

a first voltage divider module comprising a first terminal for receiving a first driving voltage;

a second voltage divider module comprising a first terminal coupled with a second terminal of the first voltage divider module, and a second terminal for receiving a second driving voltage; and a second voltage follower comprising an input terminal coupled with the second terminal of the first voltage divider module, and an output terminal for outputting the center voltage.

13. The gamma reference voltage generating circuit according to claim 12, wherein the second voltage follower comprises a second negative feedback operational amplifier;

the second negative feedback operational amplifier comprises a positive input terminal, an inverting input terminal and an output terminal;

wherein the positive input terminal of the second negative feedback operational amplifier is the input terminal of the second voltage follower; the inverting input terminal of the second negative feedback operational amplifier is coupled with the output terminal of the second negative feedback operational amplifier; the output terminal of the second negative feedback operational amplifier is the output terminal of the second voltage follower.

14. The gamma reference voltage generating circuit according to claim 12, wherein the first voltage divider module comprises at least one resistor; the second voltage divider module comprises at least one resistor.

* * * * *